US007287446B2

(12) United States Patent
Wrobel et al.

(10) Patent No.: US 7,287,446 B2
(45) Date of Patent: Oct. 30, 2007

(54) RACK AND PINION BOTTLE OPENER WITH INSERT

(76) Inventors: David J. Wrobel, 1361 Burhaven, Rochester Hills, MI (US) 48306; Patsy A. Wrobel, 1361 Burhaven, Rochester Hills, MI (US) 48306

( * ) Notice: Subject to any disclaimer, the term of this patent is extended or adjusted under 35 U.S.C. 154(b) by 0 days.

(21) Appl. No.: 11/543,495

(22) Filed: Oct. 5, 2006

(65) Prior Publication Data

US 2007/0079669 A1 Apr. 12, 2007

Related U.S. Application Data

(60) Provisional application No. 60/723,662, filed on Oct. 5, 2005.

(51) Int. Cl.
*B67B 7/62* (2006.01)
*B67B 7/02* (2006.01)

(52) U.S. Cl. ..... 81/3.37; 81/3.29

(58) Field of Classification Search ..... 81/3.37, 81/3.29

See application file for complete search history.

(56) References Cited

U.S. PATENT DOCUMENTS 695,235 A * 3/1902 Riolet ..... 81/3.37
984,661 A * 2/1911 Halk ..... 81/3.37
1,091,301 A * 3/1914 Doheny ..... 81/3.25
4,295,392 A * 10/1981 Peck ..... 81/3.32
5,016,499 A * 5/1991 Saveland ..... 81/3.37
5,924,338 A * 7/1999 Peck ..... 81/3.37
5,934,160 A * 8/1999 Gibson ..... 81/3.37
6,357,322 B1 * 3/2002 Dolan et al. ..... 81/3.37
6,530,295 B1 * 3/2003 Scott ..... 81/3.37
6,622,330 B2 * 9/2003 Puig ..... 7/155

* cited by examiner

*Primary Examiner*—David B Thomas
(74) *Attorney, Agent, or Firm*—The Weintraub Group, PLC

(57) ABSTRACT

A cork removal apparatus utilizes a rack and pinion mechanism and conventional corkscrew assembly to remove a cork from the neck of a bottle. The apparatus includes a yoke for retaining a handle portion of the corkscrew assembly and a retainer for retaining and positioning the openable end of the bottle with the mechanism. The rack and pinion mechanism is movable towards the retainer, and into position with the bottleneck and corkscrew assembly screwed into the cork thereof for mounting of the handle into the yoke, and away from the retainer, to pull the cork out of the bottle. A specially configured insert used with the retainer enables the apparatus to adapt to various bottle geometries and open a variety of bottle sizes and shapes.

13 Claims, 3 Drawing Sheets

RACK AND PINION BOTTLE OPENER WITH INSERT

CROSS-REFERENCE TO RELATED APPLICATION

This is a Completion Application of co-pending U.S. Provisional Patent Application Ser. No. 60/723,662, filed Oct. 5, 2005, the entire disclosure of which is incorporated herein by reference.

BACKGROUND OF THE INVENTION

1. Field of the Invention

The present invention relates to bottle opener for a bottle having a cork. More specifically, the invention relates to a bottle opener adapted to open a variety of bottle sizes and shapes by employing an insert to adapt to the various geometries.

2. Description of the Prior Art

Rustic or antique wine openers, made of timeless, robust materials, such as iron and wood, are classic. These openers are not only attractive, but functional. One variety of such an opener has a wood base and an iron rack and pinion extraction system. However, their functionality is limited.

Bottles that have stoppers inserted in the neck of the bottle, generically, referred to herein as "corked bottles", regardless of material, come in a variety of shapes and sizes. This is especially true of wine bottles, which vary from a long thin bottle popular with a Moscato to a larger bottle, for example, a Pinot Noir. However, the antique iron bottle openers are not capable of accommodating or uncorking a variety of bottle sizes.

An antique bottle opener that has the flexibility to open a variety of bottles would be desirable. By combining a rustic or antique bottle opener with flexible bottle opening options, an attractive and functional bottle opener would result.

Thus, it is desirable to provide an antique bottle opener with modem bottle opening flexibility.

SUMMARY OF THE INVENTION

A device for removing a cork from a bottle comprises a corkscrew assembly having a corkscrew portion and a handle portion. A base having a carrier fixedly mounted thereto, where the carrier has a first end and second end, slidably supports a rack. The rack has a plurality of teeth disposed thereon and a yoke for receiving the corkscrew handle at a first end.

A pinion is pivotally mounted to the carrier, the pinion having a plurality of teeth and a lever extending radially from the pinion. The pinion is disposed in such manner to enable the pinion teeth to engage the rack teeth so as to convert rotational motion from the lever and pinion to linear motion of the rack, whereby torque exerted upon the lever will cause the rack to translate along a longitudinal axis.

A retainer ring is mounted adjacent to the first end of the carrier. An insert is disposed in the ring. The ring and insert have a slot sufficiently wide to permit a bottle neck to be placed within the insert and ring. The insert and ring permit bottles of varying diameters and geometry to be opened by the device.

Further objects, features and advantages of the present invention will become apparent to those skilled in the art from analysis of the following written description, the accompanying drawings and the appended claims.

DESCRIPTION OF THE PREFERRED EMBODIMENT

Figure 1:
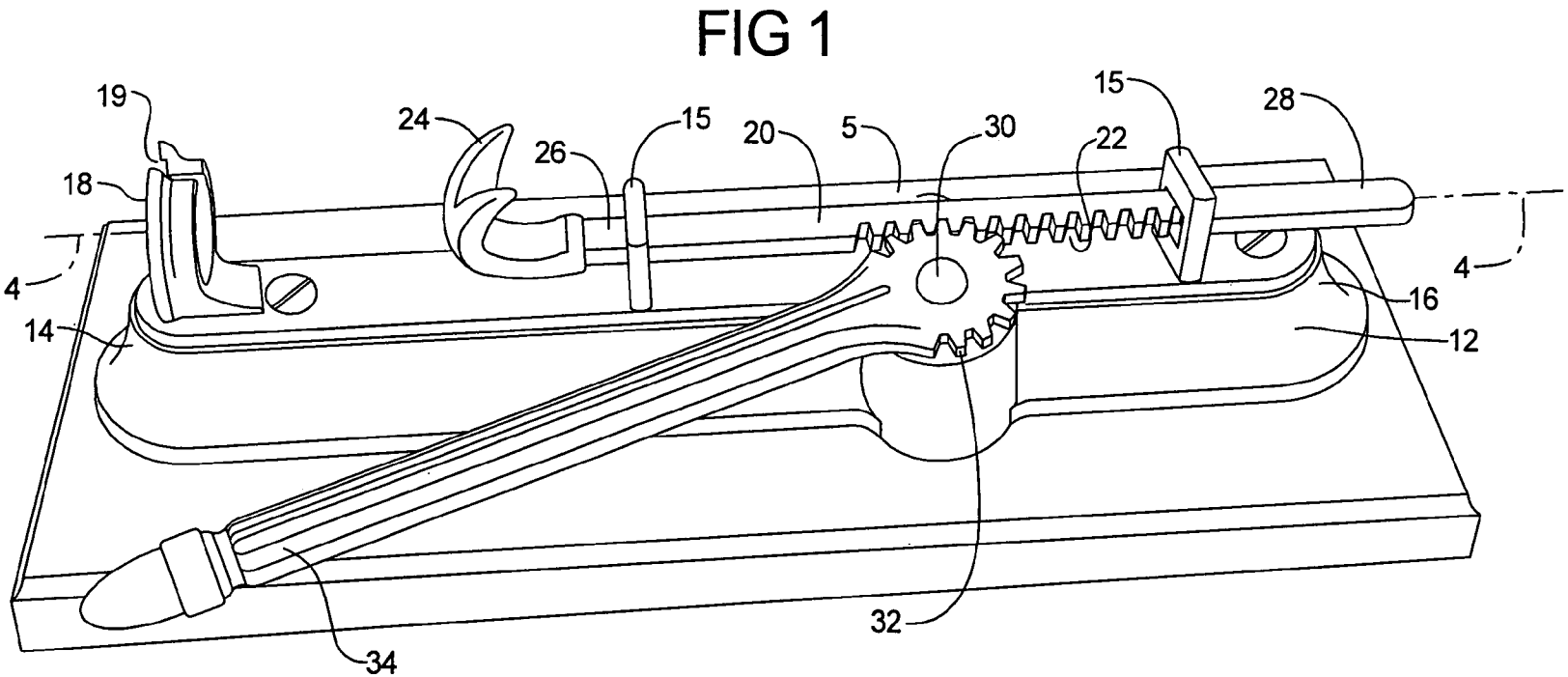
FIG. 1 is a perspective view of a rack and pinion style bottle opener according to the principles of the present invention.

Referring now to FIG. 1, a perspective view of a rack and pinion style bottle opening device or bottle opener 10 according to the principles of the present invention is shown. The bottle opener 10 comprises a carrier 12 fixedly mounted to a support base 5. The carrier 12 has a first end 14 and a second end 16. A retainer 18 is secured to the carrier 12 adjacent to the first end 14. The retainer 18 has a slot 19 sized to pass and permit the neck of a bottle to be placed within the retainer 18. A rack 20, having a first end 26 and an opposite second end 28, is slidably supported on the carrier 12 by a pair of guides 15 to permit the rack 20 to slide along a centerline 4. Each guide 15 is disposed proximal to one of the first or second ends 26, 28. The rack 20 has a plurality of teeth 22 disposed thereon.

A pinion 30 having a plurality of teeth 32 and an actuator lever 34 is pivotally mounted to the carrier 12. The teeth 32 disposed on the pinion 30 mesh with the succession of teeth 22 on the rack 20. The actuator lever 34 extends from the pinion 30 whereby torque applied to the lever 34 causes the pinion 30 to rotate or pivot and transfer torque to the teeth 32 of the pinion 30. As the pinion gear turns, the interengaged teeth 22 and 32 operate to slide the rack 20 towards the opposite ends 14 and 16 of the carrier 12, depending on which way the actuator lever is turned.

Figure 2:
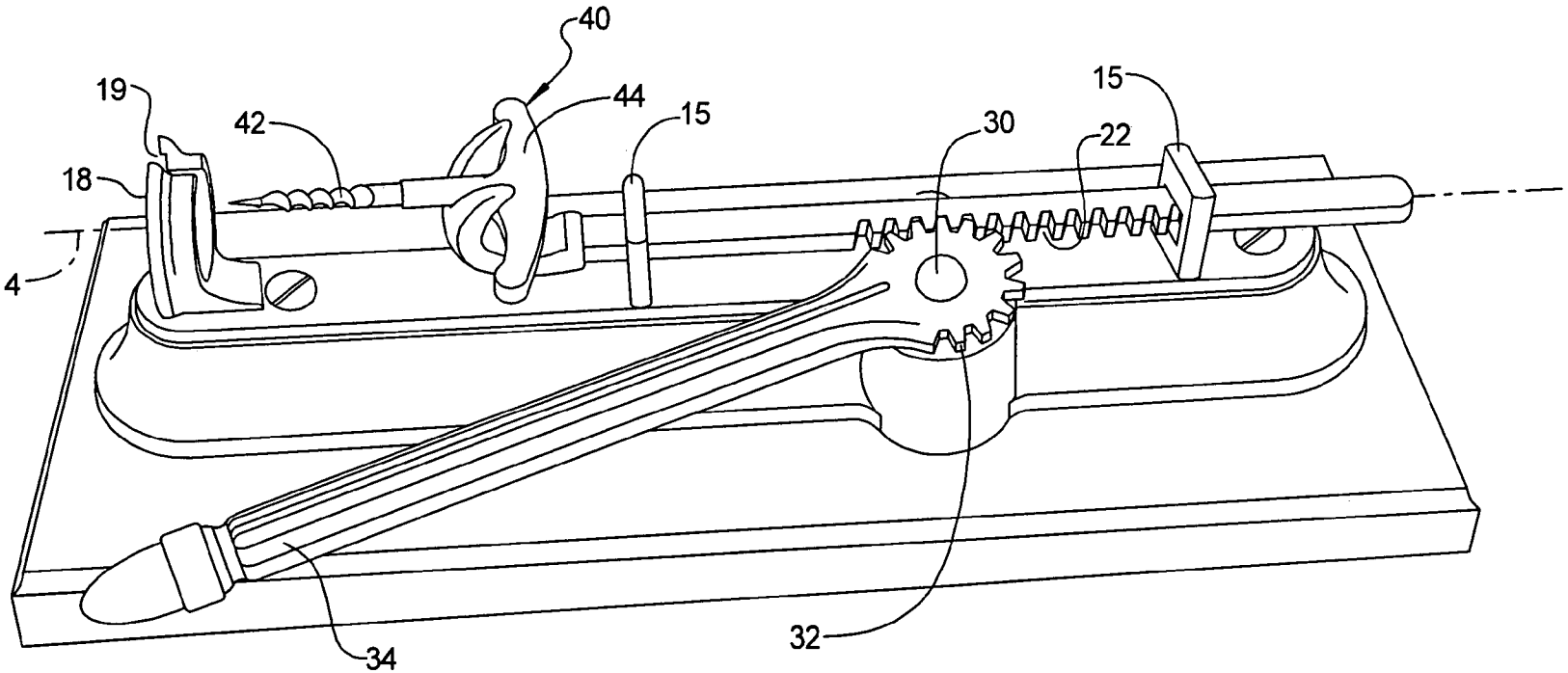
FIG. 2 is a partial perspective view of the bottle opener of FIG. 1, revealing a corkscrew assembly disposed in a yoke.

Referring also to FIG. 2, the rack 20 includes a yoke 24 disposed at the first end 26 thereof for receiving a corkscrew assembly 40. The corkscrew assembly 40 has a corkscrew portion 42 and a handle portion 44. The yoke 24 receives the handle portion 44 of the corkscrew 40.

Figure 3B:
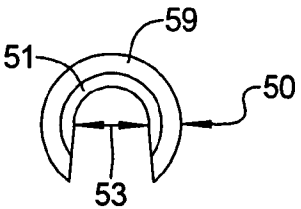
FIG. 3*b* is a plan view of the insert of FIG. 3*a*.
Figure 3A:
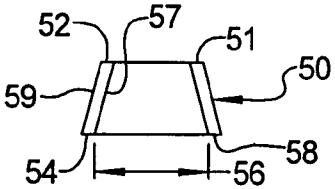
FIG. 3*a* is a front view of one embodiment of an insert according to the principles of the present invention.

As shown in FIG. 3*a*, an insert 50, which is frustoconical in shape, is removably disposed within the retainer 18. The insert 50 has a top end face 51, defined between an outer diameter 52 and an inner diameter 53, and a bottom end face or base ring 58, defined between an outer diameter 54 and inner diameter 56. The insert 50 has interior and exterior walls 57 and 59, respectively, of frustoconical shape converging from the bottom end face 58 to the top end face 51, forming a generally trapezoidal inner cross section.

The insert 50 has a slot 55 extending between the ends 51 and 58 sized to permit the neck of a bottle to pass therethrough and be placed within the insert. When disposed within the retainer 18, the slots 19 and 55 are juxtaposed and permit the neck of the bottle to be received in the insert. The bottle opening device 10 accommodate bottles of varying shapes and sizes.

In the present embodiment, the top outer diameter 52 is smaller than the bottom outer diameter 54. As such, a bottle will contact either or both of the interior wall 57 and the base ring 58, depending on the geometry of the bottle. However, it should become readily apparent to those skilled in the art that any suitable exterior shape may be employed.

The insert 50 may be formed of plastic, nylon, hard rubber or any suitable elastomeric or polymeric material known in the art.

Additionally, it is to be appreciated that the present invention may be provided as a plurality of inserts to define a kit, each having a different inner diameter size and inner cross sectional shape.

Figure 4:
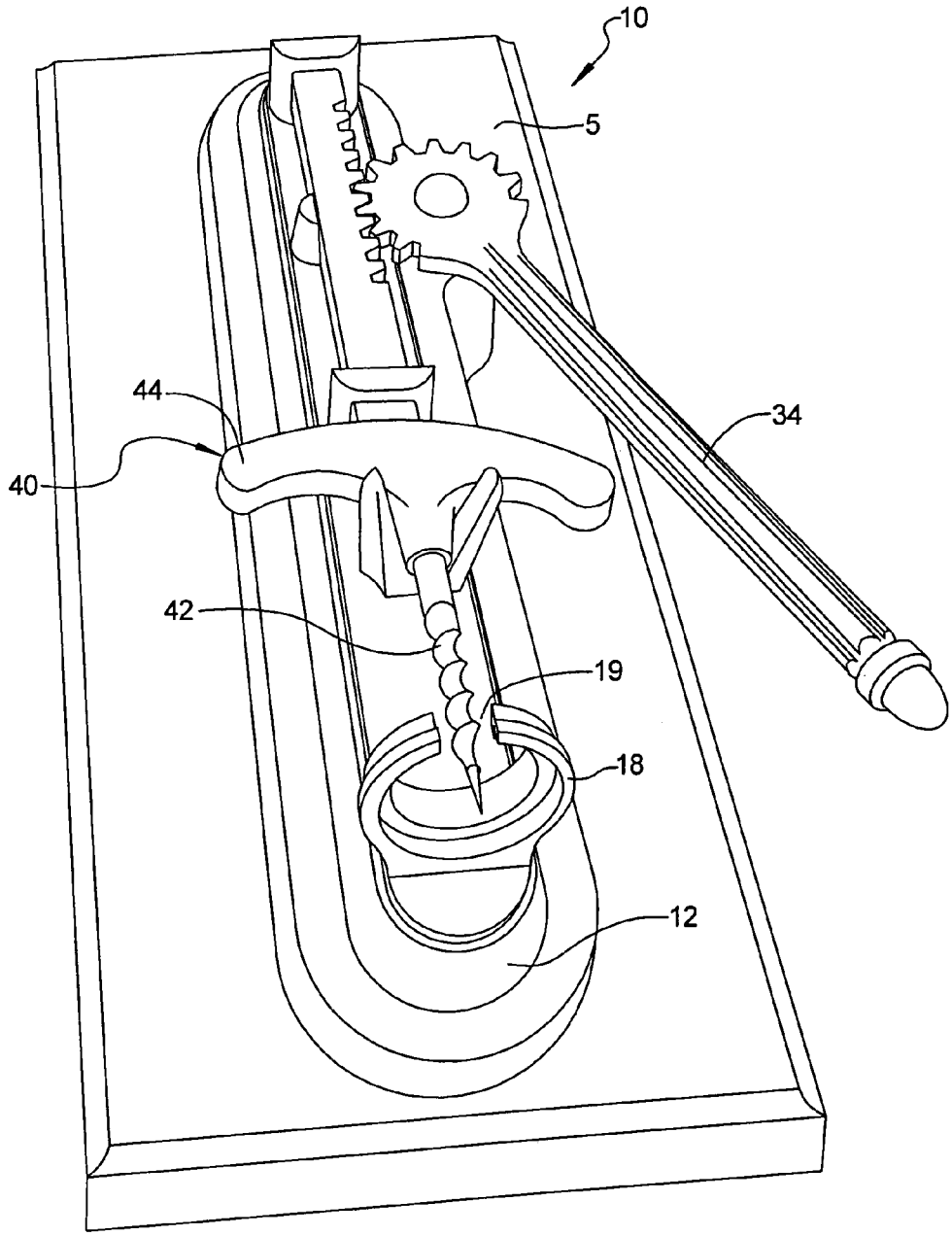
FIG. 4 is an alternate perspective view of the bottle opener of FIG. 2.

Referring now also to FIG. 4, an alternate perspective view of the bottle opener 10 of FIG. 2 is shown. In operation, the T-shaped corkscrew assembly 40 is connected to the stopper, most commonly referred to as a cork, closingly disposed in the forward end portion or neck of a wine bottle (not shown as being conventional and understood by those skilled in the art). The corkscrew portion 42 is coaxially centered and inserted into the cork by engaging the corkscrew portion 42 with the cork, applying force along the long axis of the bottle against the cork, and rotating the corkscrew assembly 40, either clockwise or counter clockwise, depending on the design of the corkscrew threads or auger. When the corkscrew 42 is fully inserted, or screwed into the cork, the handle 44 is inserted into the yoke 24 of the rack 20 and slides through the slot 19 of the retainer 18 and the slot 55 of the insert 50 so that the neck of the bottle is held by the retainer 18.

A user applies force to the actuator lever 34, which provides a torque about the pinion 30. The torque is transferred from the pinion 30 as a rotation force from the teeth 32 of the pinion 30 to the teeth 22 of the rack 20 as a linear force to the rack 20 along the axis 4. As the lever 34 is rotated clockwise, the rack 20 is forced to move away from the retainer 18 and an axial outward pulling force is applied to the corkscrew assembly 40. As the bottle is restrained from movement toward the second end 16 of the carrier 12 by the retainer 18, the rack 20 transmits a withdrawal force through the handle 44 and the cork is removed from the bottle.

The insert 50 disposed in the retainer 18 allows various bottles to be opened by the opening device 10. The insert 50 may contact the bottle at either the interior wall 57 or the base ring 58.

The foregoing discussion discloses and describes the preferred structure and control system for the present invention. However, one skilled in the art will readily recognize from such discussion, and from the accompanying drawings and claims, that various changes, modifications and variations may be made therein without departing from the true spirit and fair scope of the invention as defined in the following claims.

The invention claimed is:

1. A device for removing a cork in the neck of a bottle outwardly from the top discharge end of the bottle, comprising:

a corkscrew assembly having a corkscrew and a handle, the corkscrew screwed into the material of the cork and the handle extending from the top end of the cork, an elongated base having a first end and second end, a rack and pinion mechanism at the first end, said mechanism including a rack including a row of teeth cut along one edge, a rotatable pinion gear in engagement with the teeth of the rack, and a lever connected to the pinion wherein when the lever is turned the pinion rotates and the rack moves to the right or left and along a longitudinal axis, a split retainer ring at the second end for receiving the top end of the bottle, the retainer ring being split by a slot sufficiently wide to permit bottles of different diameter and geometry to be received in the device, and a yoke between the retainer ring and the rack and pinion mechanism for receiving the handle.

2. The device as claimed in claim 1, further comprising:

a split insert ring disposed in the split retainer ring and split by a slot aligned with the slot of the retainer ring, the slots being sufficiently wide to permit a bottle neck to be pass therethrough and be placed within and retained by the insert ring.

3. The apparatus as recited in claim 2, wherein said retainer ring includes rearward and forward ends and an interior surface having a dimension less than an exterior dimension of said insert ring wherein to prevent the insert ring from being pulled outwardly of the retainer ring and towards the yoke.

4. The device as claimed in claim 1, wherein the retainer defines a frustoconical interior wall that converges towards the mechanism, the interior wall having a diameter less than an exterior dimension of the bottle and resisting axial movement of the bottle towards the mechanism when the lever is turned, the frustoconical wall permitting bottles of varying diameters and geometry to be opened by the device.

5. Apparatus for extracting a cork from the neck of a bottle using a corkscrew assembly having a T-shaped handle portion extending from a cork screw screwed into the cork, the apparatus comprising:

a carrier having first and second ends disposed along a longitudinal axis;

a retainer fixedly mounted to the first end of the carrier, the retainer being adapted to receive, engage and center the neck of the bottle relative to the axis;

a rack and pinion actuator mechanism mounted to the second end of said carrier, said actuator mechanism comprising an axially elongated rack member movably mounted for back and forth movement relative to said longitudinal axis and having a succession of first teeth extending along its length, and a pinion member pivotally mounted for rotation relative to said rack member and having an actuation lever and second teeth in meshed engagement with the teeth of the rack;

a U-shaped yoke coupled to the first end of the rack member for movement therewith, said yoke receiving the T-shaped handle portion of the corkscrew assembly when the corkscrew is screwed into the cork in the bottle;

wherein rotation of the actuation lever moves the first end of the rack member towards and away from the retainer, respectively, to position the handle portion relative to the yoke and pull the handle portion in a direction away from the head portion and the cork outwardly of the neck of the bottle; and wherein said retainer comprises a split retainer ring fixedly connected to the carrier and a split insert ring removably mounted in said retainer ring, each said ring being split by a respective slot, each of the respective slots being juxtaposed with one another to form a gap sized to pass the neck of the bottle, and said insert ring including an interior surface to engage and prevent axial movement of the bottle towards said yoke.

6. The apparatus as recited in claim 5 wherein said insert ring includes forward and rearward ends, respectively, proximate to and distal to the yoke, and the interior surface of said insert ring is generally frustoconical and converges from the rearward end towards the forward end, a forward end portion of said interior surface having a dimension less than the exterior dimension of said neck wherein to engage and prevent the bottle from being pulled outwardly and towards the yoke.

7. The apparatus as recited in claim 5 wherein said retainer includes means for centering the axis of the corkscrew with the longitudinal axis of the mechanism when the axis of the corkscrew when screwed into the cork is not substantially coaxially aligned with the axis of the cork.

8. The apparatus as recited in claim 7 wherein said retainer includes a hollow insert movably mounted therein, said insert having an interior wall and slot extending between the ends thereof, and means for centering comprises said interior wall being frustoconical and having a diameter less than the exterior diameter of said bottle.

9. The apparatus as recited in claim 8 wherein said insert ring is of a material selected from the group consisting of a plastic, nylon, an elastomer, and hard rubber.

10. In combination, a device for controlled removal of a cork from a corked bottle having a neck and a circumferential end face, comprising:

a corkscrew assembly, said assembly having a corkscrew portion adapted to be screwed into the cork while the cork is in the bottle and a handle portion, a cork extraction apparatus, said apparatus comprising a support base having forward and rearward end portions, a rack and pinion mechanism disposed at the rearward end portion of said base, said mechanism including a rack member having first and second ends and means for connecting the corkscrew assembly to the first end of the rack, said rack mounted for movement between said end portions, a rotatable pinion member having an actuator lever, and sets of interengaging teeth operating between the rack and pinion members for moving the rack back and forth upon rotation of the lever, and means for retaining and positioning the neck portion of the bottle relative to the mechanism, said means for retaining disposed at the forward end portion of said base and including a hollow cylindrical ring of resiliently yieldable material having opposite ends and split by a slot extending between the ends, the ring having a frusto-conical interior surface that converges from the rearward end to the forward end and has a dimension less than the neck of the bottle, wherein to engage the bottle and prevent the bottle from being pulled towards the mechanism upon movement of the rack in a direction away from said ring.

11. A device for controlled removal of a cork from the head portion of a standard wine bottle using a corkscrew assembly of the type including a corkscrew screwed into the cork and a handle portion to pull the cork outwardly of the bottle, the device comprising:

a support base having a longitudinal axis;

first means for connecting the assembly of said head portion and said corkscrew assembly when the corkscrew is screwed into the cork, said means for connecting being disposed on said axis, second means for connecting said handle portion to said support base and causing said handle portion to move linearly towards said first retainer and away from said first retainer a sufficient distance to pull the cork out of the bottle, the means for connecting being disposed on said axis, and wherein said first means for connecting comprises a retainer fixably mounted to said support base, said retainer comprising a hollow split retainer body and a hollow split insert ring adjustably positionable in said retainer body, the retainer body and insert ring having opposite ends and a slot extending between their respective ends, the slots combining to form an opening sized to pass the neck of the bottle into the insert ring, and the interior surface of the ring engaging and positioning the bottleneck in the insert ring.

12. The device of claim 11 wherein the interior surface of the insert ring is frusto-conical that converges between the opposite ends and defines inlet and outlet openings, the outlet opening being smaller than the inlet opening and proximal to the second means.

13. The device of claim 12 further wherein said second means for connecting comprises a U-shaped yoke and a retainer wall, said retainer wall and yoke being axially spaced by an amount sufficient to receive and captivate the handle, and said yoke being adapted to align the axis of said corkscrew with said retainer and said longitudinal axis.

* * * * *